US006085677A

United States Patent [19]

Bell

[11] Patent Number: 6,085,677

[45] Date of Patent: Jul. 11, 2000

[54] NO/LOW WAKE, HIGH SPEED POWER CATAMARAN HULL

[75] Inventor: Loren Bell, Naples, Fla.

[73] Assignee: Fino Motion Products, Inc., Naples, Fla.

[21] Appl. No.: 09/151,553

[22] Filed: Sep. 11, 1998

[51] Int. Cl.[7] ..... B63B 1/00

[52] U.S. Cl. ..... 114/61.1; 114/61.2

[58] Field of Search ..... 114/61.1, 61.2, 114/61.21, 61.32, 61.33, 271, 283, 288, 292

[56] References Cited

U.S. PATENT DOCUMENTS 5,140,930 8/1992 Lund .
5,191,848 3/1993 Hatfield .
5,497,722 3/1996 English, Sr. .
5,570,649 11/1996 Austin ..... 114/61.2

*Primary Examiner*—Jesus D. Sotelo
*Attorney, Agent, or Firm*—Oldham & Oldham Co., LPA

[57] ABSTRACT

A catamaran multihulled craft with each hull bottom having a multifaceted inverted V shape with all bow to stern lines, IE: chines, angle change lines and center lines being parallel and rising to the deck line at the bow, and identical for each hull, and the hulls being parallel. The hull sides being vertical and flat from the chine to the main deck point and the full length of the hulls. The beam to length ratio for each hull being a minimum of 1 to 9, 1 foot of beam for each 9 feet of water line length.

39 Claims, 4 Drawing Sheets

NO/LOW WAKE, HIGH SPEED POWER CATAMARAN HULL

FIELD OF THE INVENTION

The present invention generally relates to watercraft and more particularly to a high speed, minimum/no wake power catamaran for commercial ferry service, and for pleasure and other use vessels where little or no wake is desired or necessary.

BACKGROUND OF THE INVENTION

Operation of high speed, low/minimum wake passenger vessels on average water conditions presents many engineering challenges. When conventional V or inverted V type vessels are operated at high speeds many problems are encountered including, but not limited to, large destructive wake generation, tripping or excessive leaning and sliding in corners and inadequate propeller grip due to aeration cavitation and related steering problems as well as transverse, side to side load change stability and forward loading.

In an attempt to reduce or eliminate many of the above listed problems, such as, improve transverse stability, reduce wave impact or make specific design changes, prior art inventors have devised many means of addressing some of the preexisting problems. These prior art hull inventions, both V and inverted V hulls address, almost exclusively, monohulled craft. These monohull prior art vessels have hull beam to length ratios of no more then 4 to 1 and in most instances not over 3:1. There are several prior art inventors such as Gold Coast Yachts Patent number 5,191,848 dated 1993, that have designed a wave piercing SWATH type (small waterplane submerged primary hulls) catamarans that can produce reasonable speeds with reasonable wake. The draw backs associated with catamarans of the SWATH type and extremely long narrow hull catamarans (16:1 or greater ratio) is generally deep draft, low load bearing for the size of the vessel and higher potential of underwater hull damage. Other types of catamarans such as wave piercing hulls are directed toward passenger comfort without regard to the draft or wave generating problems presented by wake size restrictions in waterway systems most suitable to passenger ferry service.

The present invention, addresses and resolves the problems that all of the prior art vessel inventions have attempted to overcome in both monohull and multihull craft including inverted V bottom monohulled craft commonly referred to as the Hickman sea sleds of 1914 or air cushion vessels, such as the keelless concave hull of Charles English, Sr. 1996, Pat. No. 5,497,722 and trihedral step hull air entrapment vessels such as Stolk 1992 Pat. No. 5,140,930. One major problem with prior art planing hull designs both conventional monohulls with V bottoms and inverted V bottoms, is the problem of either sliding sideways in a hard turn due to the vessel leaning into a turn which results in a large flat bottom area becoming parallel to the water surface often times resulting in uncontrolled side sliding or, in the case of the inverted V hull the hull side away from the direction of turn stops the vertical side of hull from slipping sideways enough to allow the vessel to remain upright or lean into a turn. When this happens the vessel weight above the waterline continues to move away from the turn causing a tripping action that can cause the craft to turn over in a direction away from the turn direction. This proven tripping of an inverted V vessel can cause serious dangers to vessel and occupants. The present invention eliminates the above identified problems due to its twin multihull configuration that prevents sliding due to its vertical sides and deep chines as well as being virtually impervious to tripping due to the fact that not enough force above the waterline can be generated to physically lift the hull on the inside of the turn out of the water. The result is that the present invention turns quickly and safely without leaning, sliding or tripping.

Prior art hull forms have not specifically addressed the growing problem of large destructive wakes at speed with the result that many areas have been forced to mandate either no/minimum wake zones or even 5 mph no wake areas to protect both the environment and other water craft. The present invention has been developed, designed and model tested with the principal objective of generating little or minimum wake at speed even when heavily loaded. Heretofore V and modified V designs have specifically avoided the wake issue concentrating on softer riding, increased economy and certain handling characteristics. The inverted V hulls have in one or two instances referenced straight vertical sides but with chines inboard of the sides such as the Hickman Sea Sled which still generates some bow and side wake, or English, which identifies a straight side from the waterline down to the chine with the sides curving heavily outboard above the at rest waterline to the gunwale. When the vessel is in motion it can cause water to curl away from the vessel when the stern settles or the vessel "cuts down" into a wave, this outward thrown water can cause side wakes. A wide transom vessel, typical of all planing monohull vessels inherently cause a larger stern wake due to the sudden release of pressure at the transom which causes a large "hump" of water to rise up aft of the craft. This hump of water then mixes with the side hull wake and moves sideways as well as aft of the vessel often causing large destructive wakes to flow away to the sides. The remaining problem with inverted V hulls is that they become nearly flat at the aft end of the craft which allows the pressures generated under the hull at the forward end of the craft to force the water, both hard and aerated, to escape sideways under the aft area of the chines again causing side generated waves or wake.

SUMMARY OF THE INVENTION

The present invention causes all of the water both hard and aerated to continually move toward the center of each hull with the lower friction aerated water rising to the highest point under the hull and acting as a friction reducing barrier to the hard water just below. Due to the chines and first plane constantly forcing new water, as well as any pressure under the hull, back toward the center of the hull, no water escapes sideways to cause any side wake. Since the same general configuration at the front (bow) of the hull forces all the normal bow wake water into the center of the hull and the water can not progress past the hull center due to the center water guide no side moving bow wake can be formed. Up to this point the vessel can not generate any wake as far aft as the transom. To address the stern area water flow, due to the narrow catamaran type of hull as well as the hull center apex height of the constant and parallel inverted hull bottom "tunnel" being close to the water surface, the hull(s) ability to generate an aft water "hump" is virtually eliminated. When coupled to the addition of the propeller generated water being forced into the small void in the water behind the vessel, while being disturbed, does not "hump" up. The water folding around the transom sides folds in toward the center of the hull and the propeller wash, striking both the propeller wash and the water from the other hull side effectively cancels the inward moving transom wake. The total result is that the vessel basically does not create any side wake and the transom wake is canceled within the confines of the width of each hull causing only small nondestructive ripples far aft of the vessel at any speed from low to extremely high speeds.

The economics of operation and relatively soft ride are primarily due to the aerated water that converges in the upper bottom apex and reduces the hard water friction on up to 40% of the wetted hull area as well as acting as a "shock absorber" to sudden upward moving hard water providing a soft comfortable ride.

The present invention embodies and resolves all of the above noted short comings in many areas. The present invention provides:

A. A virtually wake free catamaran vessel at any speed.

B. An inverted bottom catamaran with all surfaces and lines being parallel including completely vertical sides.

C. A catamaran vessel that turns quickly without sliding or tripping.

D. A catamaran vessel that rises quickly and easily to a planing attitude without aft squatting or excessive bow lift.

E. A vessel that is soft riding.

F. An economically operated vessel.

G. A catamaran vessel that has shallow draft but is capable of carrying large loads for its size.

H. A catamaran vessel that can tolerate wide variations in loading such as people movement.

I. A catamaran vessel completely suitable for protected water use in general and people ferry service as well as offshore operations.

J. A vessel engineered and model tested to fulfill all of the above items. All prior art vessels are, to some greater or lesser extent, deficient in most areas and specifically in the wake generation area.

BRIEF DESCRIPTION OF DRAWINGS

The invention is better understood by reading the following detailed description of the Preferred Embodiments with reference to the accompanying drawing figures, in which like reference numerals refer to like elements throughout and in which.

DETAILED DESCRIPTION OF PREFERRED EMBODIMENTS

Figure 1:
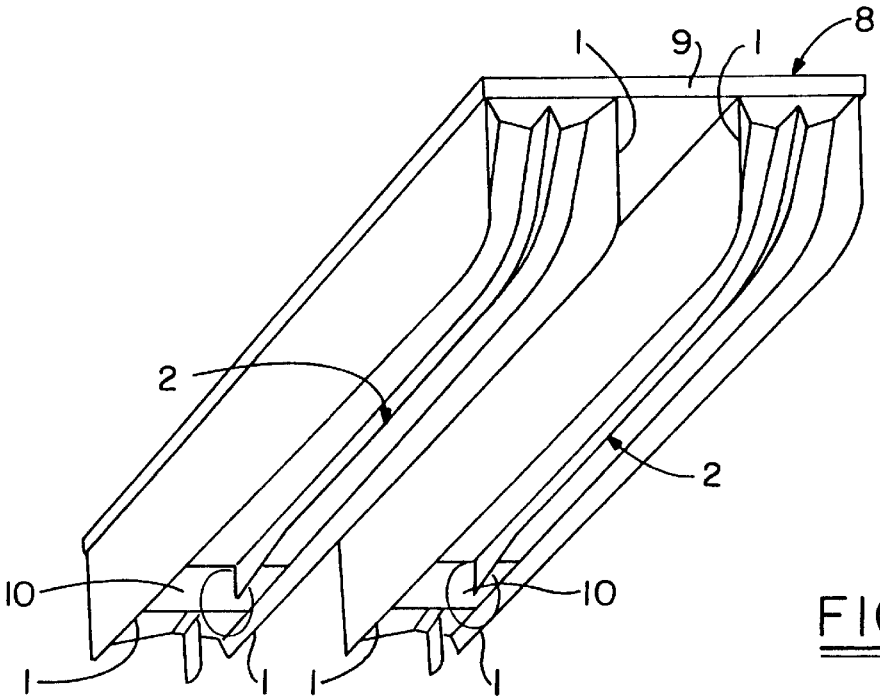
FIG. 1 is a bottom, starboard side view of the entire vessel hull viewed from the bow.

In describing preferred embodiments of the present invention, no/minimum wake catamaran, illustrated in the drawings, specific terminology is employed for the sake of clarity. However, the invention is not intended to be limited to the specific terminology or in some instances exact angles or dimensions so selected or stated. It is to be understood that each specific element includes all technical or dimensional equivalents which will operate in a similar manner to accomplish a similar result. It should be further understood that while a twin hulled catamaran vessel is described, a vessel having 3 or even 4 similarly designed hulls with the same lines as shown will produce a nearly identical result and thus the term multihull is employed several times in the following description.

Figure 2:
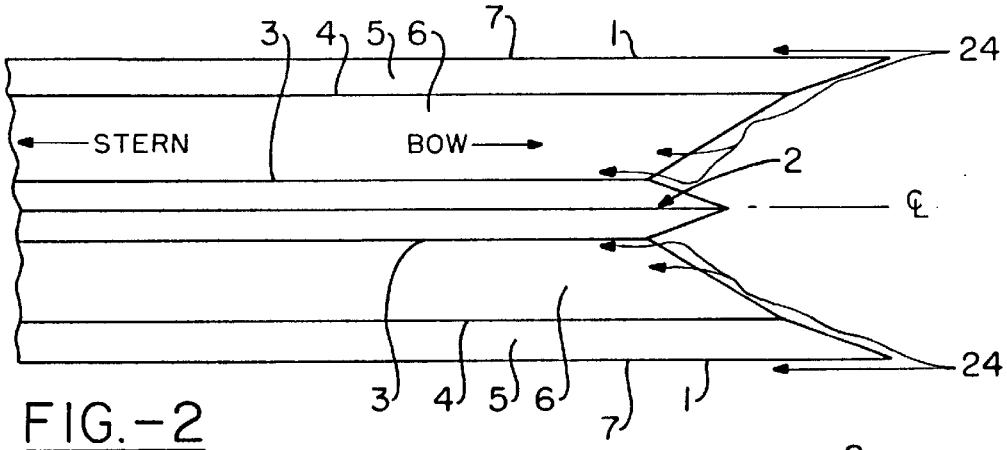
FIG. 2 is a bottom, bow view of a hull at the water line to show how the hull directs water toward the hull center and aft.
Figure 3:
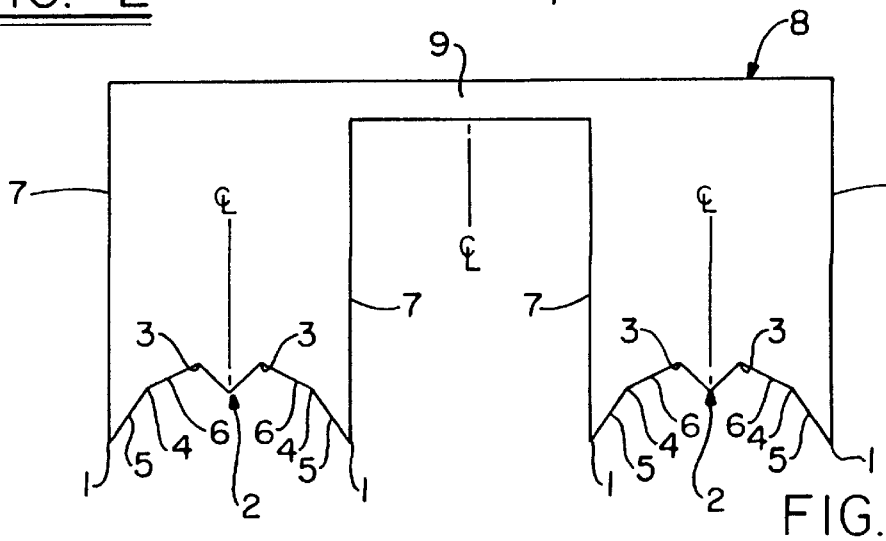
FIG. 3 is a cross section of the forward point of the hull(s) just aft of the static water line.
Figure 4:
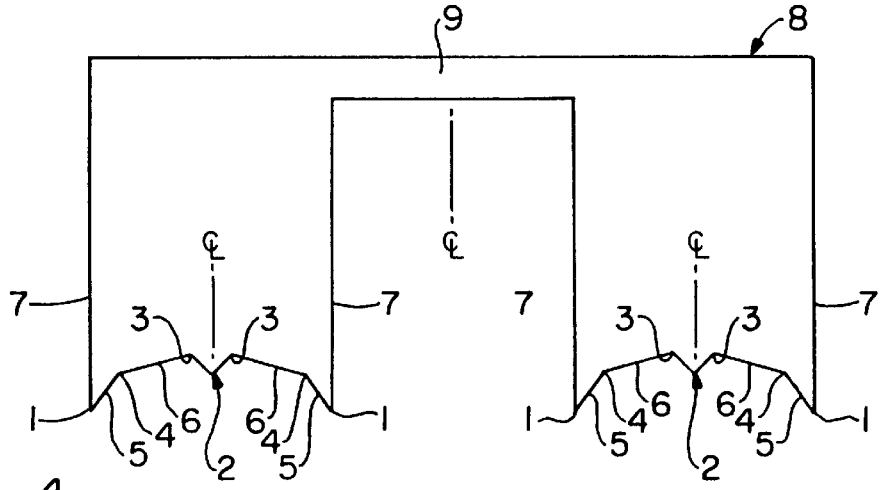
FIG. 4 is a cross section of the vessel hull(s) at the midship point.
Figure 5:
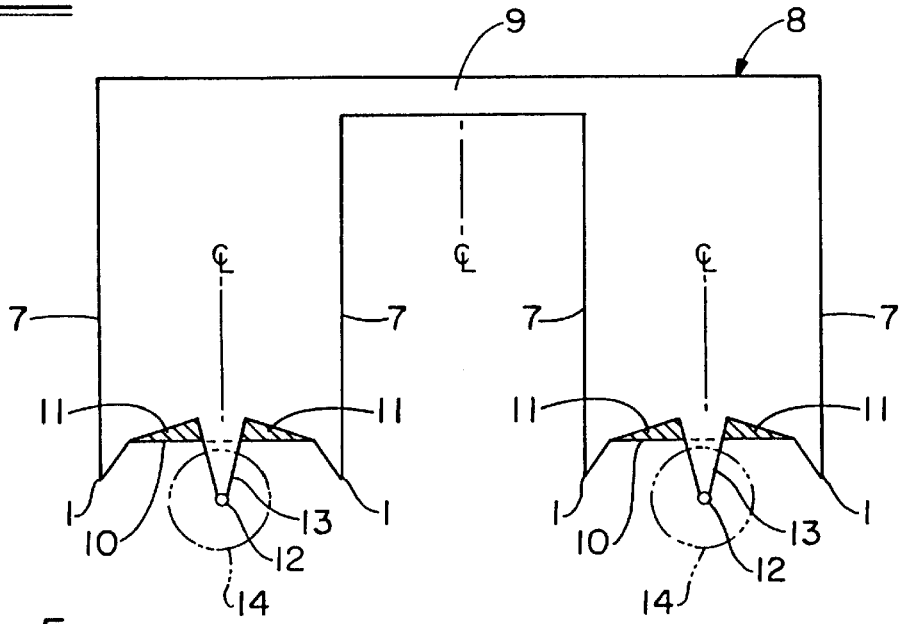
FIG. 5 is a cross section of the aft vessel hull(s) at the propeller location.
Figure 9:
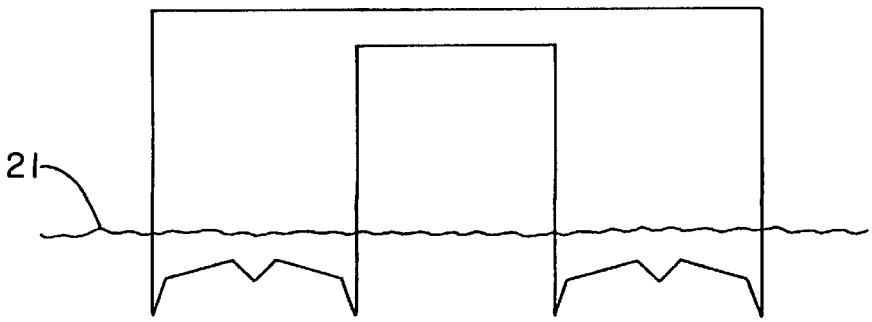
FIG. 9 shows a view of a vessel having the catamaran of the present invention at speed in port turn (bow or stern view).
Figure 6:
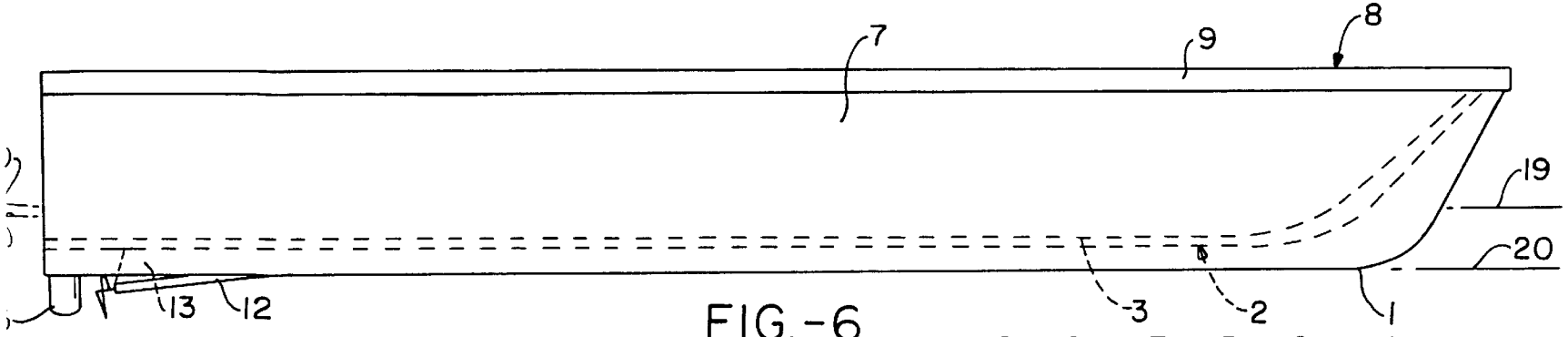
FIG. 6 is a side profile of the hull showing the chines, the center point of the hull center water guide in dotted line and the upper most apex of the intersection of the primary lift surface in dotted line and the water guide. It also shows the anticavitation plate.
Figure 7:
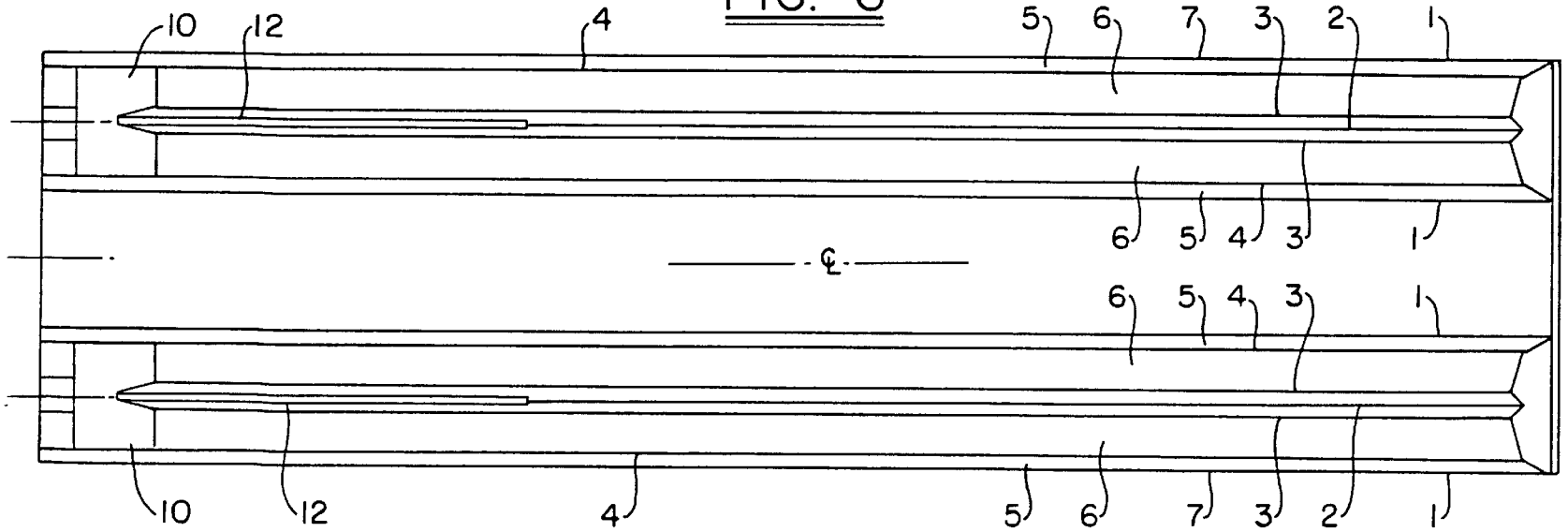
FIG. 7 is a bottom view of the vessel, showing all fore and aft lines of both hulls parallel and the location of anticavitation plate and shaft log tube and fairing.
Figure 8:
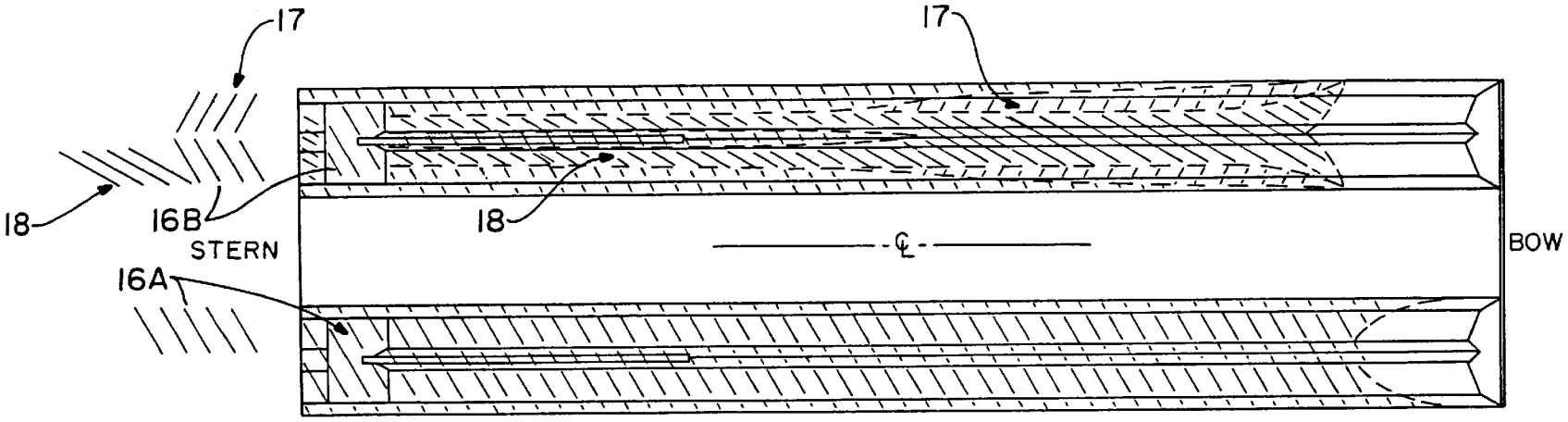
FIG. 8 is a bottom view of the vessel, showing: hard water areas at rest and at 20 knots; mildly aerated water area pattern at 20 knots; and highly aerated water area at 20 knots.
Figure 11:
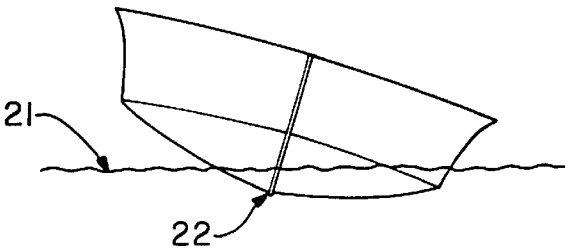
FIG. 11 shows a monohull V bottom hull at speed in port turn (bow view).
Figure 10:
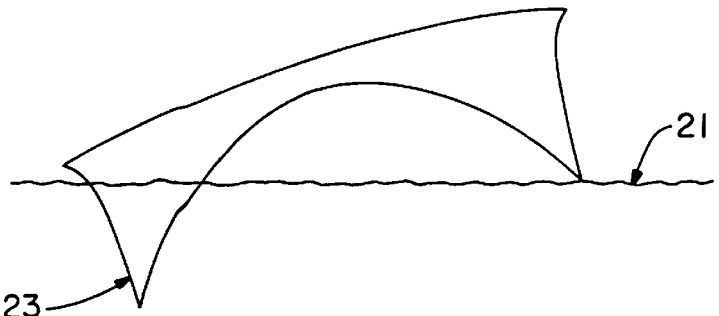
FIG. 10 shows an inverted sea sled (air cushion) vessel with vertical sides at speed in port turn (bow view).

Referring generally to FIG. 2 through FIG. 8 a preferred embodiment of the vessel hulls according to the present invention as shown in relief perspective and designated in reference FIG. 1. As shown in cross section in FIGS. 3, 4, 5 in a side view in FIG. 6 and a bottom view, in FIG. 7 the vessel hulls are both identical and with all basic fore and aft lines, numbers 1,2,3 and 4, and planes, numbers 5,6, and 7 alike in their respective locations in both hulls and parallel for both hulls and hull to hull. The deck (8) and deck/bridge structure (9) structurally hold the hulls in their precise positions in relation to each other. The lines and planes numbers 1 through 6 that create the complex shape of the inventive hull bottoms form the recessed, modified inverted V shape necessary to provide the proper water control and lift to cause the vessel to lift to a planing position easily and quickly without generating any wake away from the hull. Reasonable variations in dimensions, angles and ratios will produce similar results and are considered to be within the scope of the present invention. As may be seen in FIG. 1, the chines (1), water guide (2), upper apex (3), break line (4) between the water ingestion surface (5) and lift surface (6) including lift surface (6) and ingestion surface (5) all rise to the forward deck line from their fore and aft horizontal and parallel relation to the deck and each other at various angles and planes in the forward 15% of the vessel water line length. As may be seen in FIG. 6, the chines (1) project further forward before starting to curve up in order to trap and redirect all water into and under the forward hull surfaces between them. The forward upper chine line (1) above the water line (19) rises to the deck at approximately 30 degrees after making the curve from the straight bottom section. The entire length of the chine (1) and water ingestion surface (5) serve the same purpose, namely to turn all water contacted in and up and toward the center of the hull causing lift pressure to generate against the lift surface (6) and side of the water guide (2). This continuous directing of the incoming water, whether from the front of the hull or from under the hull prevent any water from being forced or directed away from the hull side (7) or forward toward the outboard bow area. In like manner, the center of the water divider (2) rises from the horizontal plane in a curve from a point aft of the chine rise to approximately the same height as the curve of the chine (1) above the static water line (19) and then rises to the deck (8) line at approximately a 45 degree forward angle terminating at the deck structure (9) point slightly behind a line between the chines (1) at deck level, a distance of 15% to 17% of the hull width. This greater angle and greater water approach angle insures that any water thrown sideways from the water guide (2) when impacting incoming bow water, or waves, will be redirected back and under the hull lift area (6) by the in turning bow wake water generated by the water ingestion surface (5). The turbulence caused by the in turning, trapped bow wake and water guide (2) spray generate a highly aerated water/air mix that is forced under the hull bow at the lift surface (6) and apex point (3) generating not only vertical lift for the hull to run up on but also cushions any hard water impacts as well as reducing friction in the lift (6) and apex (3), area (11). FIG. 2 shows the incoming water flow (24) as it first contacts the water ingestion surface then is turned up and back mixing with any water guide (2) water flowing under the lift surface (6) generating vertical lift. Note should be taken that the water flow past the sides (7) is straight and undisturbed with no bow wake.

As the entire water mass moves up and aft, (forward motion of the vessel) the vertical pressures under the hull build up under the entire length of the hull while the aerated water moving aft migrates up into the highest area of the lift surface (6) and upper apex (3) or area (11). This aerated water continues to act as a cushion as well as reduce hard water surface friction, as it moves aft to pass over the anticavitation plate (10) and exits the stern at the transom without creating cavitation and slippage problems to the propeller (14) located below the cavitation plate (10). To further reduce disturbed water having any effect on the propeller (14), the propeller shaft is completely enclosed in a shaft log tube (12). The shaft log tube (12) is integral with a fairing (13) that extends below the center of the water guide (2) and merges with the water guide (2) well forward of the propeller shaft log bearing just in front of the propeller (14). The result is that only solid undisturbed water enters the propeller (14) to produce the least slip or cavitation and provide the greatest propeller efficiency or thrust. As the speed of the vessel increases the forward point of contact with the water surface, see forward marked hard water area at rest (FIG. 8 16*a*), moves aft as the bow rises from the lift pressures generated under the forward hull area. At 20 knots the bow has lifted enough to cause the vessel to move forward at approximately a 5 degree bow up trim angle, see 20 knot water line FIG. 6 (20). This moves the water contact point back under the hull as shown on the forward water flow marked areas 16*b*, 17 and 18. Tile result of the 20 knot forward vessel motion reduces the hard water contact area 16*b* over 60% from the at rest/slow speed wetted hull area. It also reduces the wetted hard water friction area on the hull sides 7 by almost 45%. The lightly aerated water contact area (17) is confined to the lift surface (6) and upper portion of the water guide (2) generating a much lower friction area for approximately 30% of the running/lift areas under the hull(s). The remaining, wetted areas at a 20 knot speed are lightly aerated (18), and result in a very low friction while still transferring the vertical lift energy from the hard water beneath to the hull bottom. As the speed of the entire catamaran vessel continues to increase the running or wetted surface area, 16*b*, 17 and 18 continues to diminish, at 35 knots the vessel operates on only 50% of the at rest wetted area 16*a* with the aerated water areas 17 and 18 continuing to reduce their percentage of contact area proportionately.

The lift and friction drag characteristics of the present invention hulls result in a steady increase in speed with a corresponding steady increase in applied horsepower. Prior art vessel and nearly all dynamically supported (planing) vessels are deficient in that all have speed/power curves that require large increases in power to achieve modest increases in speed. Loading of most vessels including prior art vessel designs are deficient because all lose speed quickly as weight is increased and generally produce correspondingly larger and larger wakes due to displacing progressively more water to the side and larger stern waves from increasing pressure release at the transom. This new art invention vessel displays only a 6% to 7% reduction in speed from empty to fully loaded with no measurable increase in the aft ripple effect of the virtually nonexistent wake.

The above described preferred embodiments of this new art innovative invention describes a tremendous advance in economical, safe, no/low wake vessel design. This new invention is perfectly suited to providing ferry vessels, and vessels for all uses including pleasure craft that can be operated at reasonable and high speeds in wake restricted operational areas heretofore marginal at best, unless operating at idle speed, to existing prior art craft.

What is claimed is:

1. A boat hull for use with passenger ferry vessels and with pleasure and other watercraft where little to no wake is desired, said boat hull comprised of:

a V-shaped water dividing member centrally situated in a laterally extending bottom section of said boat hull;

a first lift generating member and a second lift generating member that along with said water dividing member, respectively define a first area including a highly aerated water/air mix and a second area including a highly aerated water/air mix;

a first water ingestion member situated proximate to said first area including a highly aerated water/air mix and a second water ingestion member situated proximate to said second area including a highly aerated water/air mix; and a first chine member defined by said first water ingestion member and a first hull side member and a second chine member defined by said second water ingestion member and a second hull side member.

2. A boat hull as claimed in claim 1, wherein said V-shaped water dividing member, said first lift generating member, said second lift generating member, said first water ingestion member, said second water ingestion member, said first chine member and said second chine member extend from a bow section of said hull to a stern section of said hull.

3. A boat hull as claimed in claim 2, wherein said V-shaped water dividing member includes: a first water dividing portion running longitudinally along the underside region of said hull from a beginning point located in said stern section and to a first water dividing portion end point located forward of said beginning point and aft of said bow section; a second water dividing portion that communicates with said first water dividing portion at said first water dividing portion end point and that curves upwardly away from said first water dividing portion end point to a second water dividing portion end point that is located forward of said first water dividing portion end point and aft of said bow section; and a third water dividing portion running angularly upward along the frontal region of said hull from said second water dividing portion end point to a third water dividing portion end point located forward of said second water dividing portion end point and at the bow section of said hull.

4. A boat hull as claimed in claim 3, wherein said first lift generating member and said second lift generating member include: a first lift generating portion running longitudinally along the underside region of said hull from a beginning point located in said stern section and to a first lift generating portion end point located forward of said beginning point and aft of said bow section; a second lift generating portion that communicates with said first lift generating portion at said first lift generating portion end point and that curves upwardly away from said first lift generating portion end point to a second lift generating portion end point that is located forward of said first lift generating portion end point and aft of said bow section; and a third lift generating portion running angularly upward along the frontal region of said hull from said second lift generating portion end point to a third lift generating portion end point located forward of said second lift generating portion end point and at the bow section of said hull.

5. A boat hull as claimed in claim 4, wherein said first chine member and said second chine member include: a first water ingestion portion running longitudinally along the underside region of said hull from a beginning point located in said stern section and to a first water ingestion portion end point located forward of said beginning point and aft of said bow section; a second water ingestion portion that communicates with said first water ingestion portion at said first water ingestion portion end point and that curves upwardly away from said first water ingestion portion end point to a second water dividing portion end point that is located forward of said first water ingestion portion end point and aft of said bow section; and a third water ingestion portion running angularly upward along the frontal region of said hull from said second water dividing portion end point to a third water ingestion portion end point located forward of said second water ingestion portion end point and at the bow section of said hull.

6. A boat hull as claimed in claim 5, wherein said first water ingestion portion end point lies further forward from said beginning point located in said stern section that said first water dividing portion end point.

7. A boat hull as claimed in claim 6, wherein said hull has a vessel water line length and said first water ingestion portion end point and said first water dividing portion end point are situated in the forward 15 percent of said vessel water line length.

8. A boat hull as claimed in claim 7, wherein said hull has an average water line and said third water ingestion portion rises angularly upward at a forward angle of approximately 30 degrees relative to said average water line and said first water dividing portion rises angularly upward at a forward angle of 45 degrees relative to said average water line.

9. A boat hull as claimed in claim 8, wherein said hull has a hull width equivalent to the length of a line extending between said third water ingestion portion end point of said first chine member and said second chine member and wherein said third water dividing portion end point is located at a distance equivalent to 15 percent to 17 percent of said hull width, said distance being measured along a line that is perpendicular to said line extending between said third water ingestion portion end point of said first chine member and said second chine member.

10. A boat hull as claimed in claim 9, wherein said hull includes an anticavitation means.

11. A boat hull as claimed in claim 10, wherein said hull includes a shaft log tube member and a fairing member, said shaft log tube member enclosing a propeller shaft.

12. A boat hull as claimed in claim 11, wherein said shaft log tube member and said fairing member cooperate as an integral assembly that extends below said first water dividing portion of said V-shaped water dividing member and merges with said first water dividing portion.

13. A boat hull as claimed in claim 12, wherein said anticavitation means is a plate situated in said stern section of said hull, generally aft of said shaft log tube member and said fairing member and above a propeller means provided on an end of said propeller shaft.

14. A boat hull for use with passenger ferry vessels and with pleasure and other watercraft where little to no wake is desired, said boat hull comprised of:

a plurality of laterally separated parallel hull bottom sections;

a bridge member for rigidly connecting said plurality of hull bottom sections; and a deck member secured to said bridge member for further connecting and for structurally holding said hull bottom sections in position in relation to each other; and wherein said hull bottom sections include:

a V-shaped water dividing member situated in a central cross-sectional region of said hull bottom sections;

a first lift generating member and a second lift generating member, that along with said water dividing member, respectively define a first area including a highly aerated water/air mix and a second area including a highly aerated water/air mix;

a first water ingestion member situated proximate to said first area including a highly aerated water/air mix and a second water ingestion member situated proximate to said second area including a highly aerated water/air mix; and a first chine member defined by said first water ingestion member and a first hull side member and a second chine member defined by said second water ingestion member and a second hull side member.

15. A boat hull as claimed in claim 14, wherein said V-shaped water dividing member, said first lift generating member, said second lift generating member, said first water ingestion member, said second water ingestion member, said first chine member and said second chine member of said hull bottom sections extend from a bow section of said hull to a stern section of said hull.

16. A boat hull as claimed in claim 15, wherein said V-shaped water dividing member of said hull bottom sections includes: a first water dividing portion running longitudinally along the underside region of said hull from a beginning point located in said stern section and to a first water dividing portion end point located forward of said beginning point and aft of said bow section, a second water dividing portion that communicates with said first water dividing portion at said first water dividing portion end point and that curves upwardly away from said first water dividing portion end point to a second water dividing portion end point that is located forward of said first water dividing portion end point and aft of said bow section; and a third water dividing portion running angularly upward along the frontal region of said hull from said second water dividing portion end point to a third water dividing portion end point located forward of said second water dividing portion end point and at the bow section of said hull.

17. A boat hull as claimed in claim 16, wherein said first lift generating member and said second lift generating member of said hull bottom sections include: a first lift generating portion running longitudinally along the underside region of said hull from a beginning point located in said stem section and to a first lift generating portion end point located forward of said beginning point and aft of said bow section; a second lift generating portion that communicates with said first lift generating portion at said first lift generating portion end point and that curves upwardly away from said first lift generating portion end point to a second lift generating portion end point that is located forward of said first lift generating portion end point and aft of said bow section; and a third lift generating portion running angularly upward along the frontal region of said hull from said second lift generating portion end point to a third lift generating portion end point located forward of said second lift generating portion end point and at the bow section of said hull.

18. A boat hull as claimed in claim 17, wherein said first chine member and said second chine member of said hull bottom members include: a first water ingestion portion running longitudinally along the underside region of said hull from a beginning point located in said stern section and to a first water ingestion portion end point located forward of said beginning point and aft of said bow section; a second water ingestion portion that communicates with said first water ingestion portion at said first water ingestion portion end point and that curves upwardly away from said first water ingestion portion end point to a second water dividing portion end point that is located forward of said first water ingestion portion end point and aft of said bow section; and a third water ingestion portion running angularly upward along the frontal region of said hull from said second water dividing portion end point to a third water ingestion portion end point located forward of said second water ingestion portion end point and at the bow section of said hull.

19. A boat hull as claimed in claim 18, wherein said first water ingestion portion end point lies further forward from said beginning point located in said stern section that said first water dividing portion end point.

20. A boat hull as claimed in claim 19 wherein said hull bottom sections have a vessel water line length and said first water ingestion portion end point and said first water dividing portion end point are situated in the forward 15 percent of said vessel water line length.

21. A boat hull as claimed in claim 20, wherein said hull bottom sections have an average water line and said third water ingestion portion rises angularly upward at a forward angle of approximately 30 degrees relative to said average water line and said first water dividing portion rises angularly upward at a forward angle of 45 degrees relative to said average water line.

22. A boat hull as claimed in claim 21, wherein said hull bottom sections have a hull width equivalent to the length of a line extending between said third water ingestion portion end point of said first chine member and said second chine member and wherein said third water dividing portion end point is located at a distance equivalent to 15 percent to 17 percent of said hull width, said distance being measured along a line that is perpendicular to said line extending between said third water ingestion portion end point of said first chine member and said second chine member.

23. A boat hull as claimed in claim 22 wherein said hull bottom sections include an anticavitation means.

24. A boat hull as claimed in claim 23, wherein said hull bottom sections include a shaft log tube member and a fairing member, said shaft log tube member enclosing a propeller shaft.

25. A boat hull as claimed in claim 24, wherein said shaft log tube member and said fairing member cooperate as an integral assembly that extends below said first water dividing portion of said V-shaped water dividing member and merges with said first water dividing portion.

26. A boat hull as claimed in claim 25, wherein said anticavitation means is a plate situated in said stern section of said hull bottom section, generally aft of said shaft log tube member and said fairing member and above a propeller means provided on an end of said propeller shaft.

27. A catamaran hull for use with passenger ferry vessels and with pleasure and other watercraft where little to no wake is desired, said catamaran hull comprised of:

a two laterally separated, parallel hull bottom sections including a V-shaped water dividing member situated in a central cross-sectional region of said hull bottom sections; a first lift generating member and a second lift generating member, that along with said water dividing member, respectively define a first area including a highly aerated water/air mix and a second area including a highly aerated water/air mix; a first water ingestion member situated proximate to said first area including a highly aerated water/air mix and a second water ingestion member situated proximate to said second area including a highly aerated water/air mix; and a first chine member defined by said first water ingestion member and a first hull side member and a second chine member defined by said second water ingestion member and a second hull side member;

a bridge member for rigidly connecting said hull bottom sections; and a deck member secured to said bridge member for further connecting and for structurally holding said hull bottom sections in position in relation to each other.

28. A boat hull as claimed in claim 27, wherein said V-shaped water dividing member, said first lift generating member, said second lift generating member, said first water ingestion member, said second water ingestion member, said first chine member and said second chine member of said hull bottom sections extend from a bow section of said hull to a stern section of said hull.

29. A boat hull as claimed in claim 28, wherein said V-shaped water dividing member of said hull bottom sections includes: a first water dividing portion running longitudinally along the underside region of said hull from a beginning point located in said stern section and to a first water dividing portion end point located forward of said beginning point and aft of said bow section; a second water dividing portion that communicates with said first water dividing portion at said first water dividing portion end point and that curves upwardly away from said first water dividing portion end point to a second water dividing portion end point that is located forward of said first water dividing portion end point and aft of said bow section; and a third water dividing portion running angularly upward along the frontal region of said hull from said second water dividing portion end point to a third water dividing portion end point located forward of said second water dividing portion end point and at the bow section of said hull.

30. A boat hull as claimed in claim 29, wherein said first lift generating member and said second lift generating member of said hull bottom sections include: a first lift generating portion running longitudinally along the underside region of said hull from a beginning point located in said stern section and to a first lift generating portion end point located forward of said beginning point and aft of said bow section; a second lift generating portion that communicates with said first lift generating portion at said first lift generating portion end point and that curves upwardly away from said first lift generating portion end point to a second lift generating portion end point that is located forward of said first lift generating portion end point and aft of said bow section; and a third lift generating portion running angularly upward along the frontal region of said hull from said second lift generating portion end point to a third lift generating portion end point located forward of said second lift generating portion end point and at the bow section of said hull.

31. A boat hull as claimed in claim 30, wherein said first chine member and said second chine member of said hull bottom members include: a first water ingestion portion running longitudinally along the underside region of said hull from a beginning point located in said stern section and to a first water ingestion portion end point located forward of said beginning point and aft of said bow section; a second water ingestion portion that communicates with said first water ingestion portion at said first water ingestion portion end point and that curves upwardly away from said first water ingestion portion end point to a second water dividing portion end point that is located forward of said first water ingestion portion end point and aft of said bow section; and a third water ingestion portion running angularly upward along the frontal region of said hull from said second water dividing portion end point to a third water ingestion portion end point located forward of said second water ingestion portion end point and at the bow section of said hull.

32. A boat hull as claimed in claim 31, wherein said first water ingestion portion end point lies further forward from said beginning point located in said stern section that said first water dividing portion end point.

33. A boat hull as claimed in claim 32, wherein said hull bottom sections have a vessel water line length and said first water ingestion portion end point and said first water dividing portion end point are situated in the forward 15 percent of said vessel water line length.

34. A boat hull as claimed in claim 33, wherein said hull bottom sections have an average water line and said third water ingestion portion rises angularly upward at a forward angle of approximately 30 degrees relative to said average water line and said first water dividing portion rises angularly upward at a forward angle of 45 degrees relative to said average water line.

35. A boat hull as claimed in claim 34, wherein said hull bottom sections have a hull width equivalent to the length of a line extending between said third water ingestion portion end point of said first chine member and said second chine member and wherein said third water dividing portion end point is located at a distance equivalent to 15 percent to 17 percent of said hull width, said distance being measured along a line that is perpendicular to said line extending between said third water ingestion portion end point of said first chine member and said second chine member.

36. A boat hull as claimed in claim 35 wherein said hull bottom sections include an anticavitation means.

37. A boat hull as claimed in claim 36, wherein said hull bottom sections include a shaft log tube member and a fairing member, said shaft log tube member enclosing a propeller shaft.

38. A boat hull as claimed in claim 32, wherein said shaft log tube member and said fairing member cooperate as an integral assembly that extends below said first water dividing portion of said V-shaped water dividing member and merges with said first water dividing portion.

39. A boat hull as claimed in claim 38, wherein said anticavitation means is a plate situated in said stern section of said hull bottom section, generally aft of said shaft log tube member and said fairing member and above a propeller means provided on an end of said propeller shaft.

* * * * *